US006103105A

United States Patent [19]

Cooper et al.

[11] Patent Number: 6,103,105

[45] Date of Patent: Aug. 15, 2000

[54] PROCESS FOR THE REDUCTION OF SULPHUR CONTENT IN FCC HEAVY GASOLINE

[75] Inventors: Barry Cooper, Charlottenlund; Kim Grøn Knudsen, Virum, both of Denmark

[73] Assignee: Haldor Topsoe A/S, Lyngby, Denmark

[21] Appl. No.: 09/262,183

[22] Filed: Mar. 4, 1999

[30] Foreign Application Priority Data

Mar. 4, 1998 [DK] Denmark ..... 0295/98

[51] Int. Cl.[7] ..... C10G 45/00

[52] U.S. Cl. ..... 208/210; 208/218; 208/93; 208/211

[58] Field of Search ..... 208/93, 211, 210, 208/218

[56] References Cited

U.S. PATENT DOCUMENTS

| | | | |
|---|---|---|---|
| 3,451,923 | 6/1969 | Welty, Jr. et al. | 208/211 |
| 3,464,915 | 9/1969 | Paterson et al. | 208/218 |
| 3,531,398 | 9/1970 | Adams et al. | 208/216 |
| 4,990,242 | 2/1991 | Louie | 208/218 |
| 5,407,559 | 4/1995 | Degnan | 208/89 |

*Primary Examiner*—Helane E. Myers

*Attorney, Agent, or Firm*—Ostrolenk, Faber, Gerb & Soffen, LLP

[57] ABSTRACT

A process for the reduction of sulphur content in a FCC gasoline includes fractionation of the FCC gasoline into three fractions: a light fraction comprising 50–80% of the FCC gasoline, an intermediate boiling fraction comprising 10–30% of the FCC gasoline, and a heavy fraction comprising 5–20% of the FCC gasoline. The heaviest fraction is hydrotreated in the first bed of a hydrotreater at conditions that result in essentially total removal of the sulphur. The effluent from the first bed is quenched with the intermediate fraction. The combined oil stream is hydrotreated in a second and final bed in the hydrotreater at conditions that ensure the required overall sulphur reduction.

1 Claim, 1 Drawing Sheet

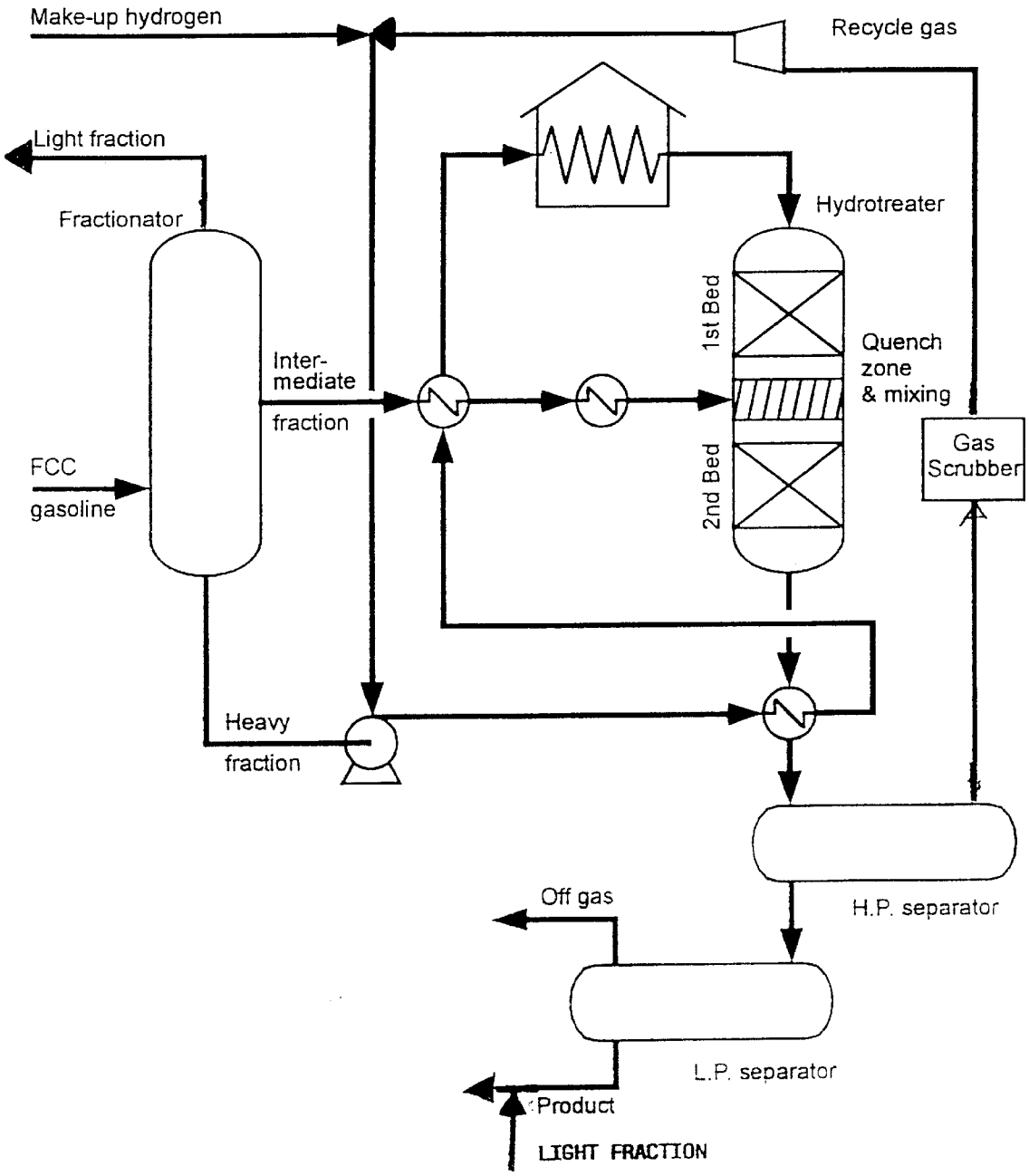
Make-up hydrogen
Recycle gas
Light fraction
Fractionator
Hydrotreater
1st Bed
Quench
zone
& mixing
Inter-
mediate
fraction
Gas
Scrubber
FCC
gasoline
2nd Bed
Heavy
fraction
H.P. separator
Off gas
L.P. separator
Product
LIGHT FRACTION

PROCESS FOR THE REDUCTION OF SULPHUR CONTENT IN FCC HEAVY GASOLINE

BACKGROUND

The present invention relates to the reduction of sulphur content in FCC heavy gasoline.

There is increasing demand to reduce the sulphur content of gasoline in order to meet new requirements for low exhaust emissions. The largest contribution to sulphur in the gasoline pool comes from FCC gasoline. The sulphur content can be reduced by hydrotreating. However, hydrotreating results in saturation of olefin species in the FCC gasoline leading to unacceptable losses in Octane Number. Several processes have been proposed whereby the FCC gasoline is fractionated into a light (low boiling) fraction and a heavy (high boiling) fraction, and where only the heavy fraction is hydrotreated. The reason for doing this is linked to the distribution of sulphur and olefin species as a function of boiling point. As apparent from Table 1, most of the sulphur is found in the highest boiling approximately 30% of the FCC gasoline, whereas most of the olefins are found in the lightest approximately 70% of the FCC gasoline. By hydrotreating only the heavy fraction and blending the hydrotreated product with the untreated light fraction, the required degree of desulphurization can be obtained with moderate olefin reduction and moderate loss of Octane Number. However, the loss of Octane Number is usually unacceptably high.

TABLE 1

Analysis of an FCC Gasoline

| Boiling Range ° C. | Liquid Vol. % | Cumulative Liquid vol. % | S, wppm | Olefins vol. % |
|---|---|---|---|---|
| IBP-50 | 2.1 | 21 | 3 | 48.6 |
| 50–75 | 18.2 | 39.2 | 178 | 59.7 |
| 75–100 | 10.6 | 49.8 | 219 | 46.2 |
| 100–125 | 11.4 | 61.2 | 565 | 34.8 |
| 125–150 | 13.2 | 74.4 | 633 | 22 |
| 150–175 | 8.3 | 82.7 | 576 | 12.6 |
| 175–200 | 9.3 | 92 | 580 | 9.4 |
| 200+ | 8 | 100 | 3255 | 3.2 |

DESCRIPTION OF THE PRESENT INVENTION

The present invention embodies four steps:

fractionation of the FCC gasoline into three fractions: a light fraction consisting of the lightest approximately 50–80% of the FCC gasoline, an intermediate fraction consisting of approximately the next highest boiling 10–30% of the FCC gasoline, and a heavy fraction consisting of the highest approximately 5–20% of the FCC gasoline;

hydrotreating of the heaviest fraction in the first bed of a hydrotreater at conditions that result in essentially total removal of the sulphur;

quenching of the effluent from the first bed with the intermediate fraction; and hydrotreating of the combined oil stream in a second and final bed in the hydrotreater at conditions that ensure the required overall sulphur reduction.

A flow diagram of the process is shown in FIG. 1, as an example. The precise configuration of the recycle gas system, the make-up gas system, the use or not of gas recycle, and the configuration of the let down system are not important for the invention.

The invention makes use of the fact that the sulphur content of the heavy fraction is typically 5–10 times that of the intermediate fraction, and the olefin content is 2–4 times lower. In the first hydrotreater bed, the sulphur is reduced to a very low level, typically at a high average bed temperature. At these conditions the degree of olefin saturation will be high, but this has little effect on total olefin reduction (and thereby has little effect on Octane Number reduction) since the olefin content of this fraction is low. The effluent of the first bed is mixed with the intermediate fraction which is introduced into the reactor at a low temperature. The mixing occurs in a mixing and quenching zone. The two streams are led into the second bed. The sulphur content of the mixed stream will be typically about ⅔ that of the intermediate fraction, and the required degree of desulphurization of the mixed stream will be quite low. This means that mild conditions (e.g. low temperatures) can be used in the second bed ensuring low olefin saturation.

An example of the advantage of the present invention over the conventional hydrotreating of the heavy fraction is given below.

EXAMPLE 1

An FCC gasoline has the following destribution of sulphur and olefins as a function of boiling point:

TABLE 2

| Fraction | Boiling Range ° C. | SG | Liquid vol. % | S wppm | Olefins vol. % | Mass % |
|---|---|---|---|---|---|---|
| 1 | IBP-150° C. | 0.726 | 70 | 300 | 45 | 65.4 |
| 2 | 150–200° C. | 0.848 | 20 | 500 | 10 | 22.1 |
| 3 | 200+° C. | 0.895 | 10 | 3500 | 3 | 11.7 |

The required sulphur content of the full range gasoline is 230 wppm which means that the sulphur content of the combined fractions 2+3 must be reduced to 100 wppm. The charge of the full range FCC gasoline is 30,000 Bbls/day. Only the heaviest 30 vol % (fractions 2+3) is hydrotreated.

EXAMPLE 1a

Hydrotreatment of the combined fractions 2+3 sulphur content of the combined streams is 1538 wppm; olefin content is 7.7 vol %.

The required operating conditions to give 100 wppm sulphur in the product are LHSV=3.4 $m^3/m^3/h$ and WABT=320° C. The olefin content of the product=0.9% corresponding to 88% olefin saturation. The required catalyst volume is 29.8 $m^3$.

EXAMPLE 1b

Hydrotreatment of fraction 3 followed by hydrotreatment of fraction 2 combined with hydrotreated fraction 3.

Over the first bed the conditions are:

LHSV=4.3 $m^3/m^3/h$, WABT=36020 C. Product sulphur=10 wppm, olefin content=0.001%. The required catalyst volume is 7.8 $m^3$.

Over the second bed the conditions are:

LHSV=4.6 $m^3/m^3/h$, WABT=302° C. Product sulphur=100 wppm, olefin content=3.3% corresponding to 57% overall olefin saturation. The required catalyst volume of the second bed is 21.8 $m^3$ giving a total catalyst volume of 29.6 $m^3$ i.e. essentially the same as in Example 1a.

Overall, the same product sulphur is obtained using the same volume of catalyst at about 3.5° C. lower WABT and with 2.4 volt absolute lower olefin loss.

In the above calculations, the following assumptions were made:

HDS reactions are first order;

the reactivity of fraction 2 for HDS is 1.5 times that of the reactivity of fraction 3;

the order of reaction for olefin removal is one;

the reactivity of olefins in fraction 2 is equal to that of olefins in fraction 3;

the ratio ($k_{HDS}$ fraction 2)/($k_{olefin\ removal}$) at 320° C. is 1.7;

the activation energy for HDS is 24000 cal/mole/K;

the activation energy for olefin removal is 30000 cal/mole/K;

$k_{HDS}$ fraction 2 is 5.09 at 320° C.

What is claimed is:

1. A process for the reduction of sulphur content in a FCC gasoline comprising the steps of:

fractionation of the FCC gasoline into three fractions: a light fraction comprising 50–80% of the FCC gasoline, an intermediate boiling fraction comprising 10–30% of the FCC gasoline, and a heavy fraction comprising 5–20% of the FCC gasoline;

hydrotreating of the heaviest fraction in the first bed of a hydrotreater at conditions that result in essentially total removal of the sulphur;

quenching of the effluent from the first bed with the intermediate fraction to form a combined oil stream; and hydrotreating of the combined oil stream in a second bed in the hydrotreater at conditions that ensure the required overall sulphur reduction.

* * * * *